United States Patent [19]

Eriksson et al.

[11] 4,075,926

[45] Feb. 28, 1978

[54] GUN BARREL

[75] Inventors: Kjell Viktor Eriksson; Ivan Åslund, both of Karlskoga, Sweden

[73] Assignee: AB Bofors, Bofors, Sweden

[21] Appl. No.: 685,574

[22] Filed: May 12, 1976

[30] Foreign Application Priority Data

May 30, 1975 Sweden ..... 7506177

[51] Int. Cl.[2] ..... F41F 17/08

[52] U.S. Cl. ..... 89/16

[58] Field of Search ..... 89/14, 16, 41 ME, 135; 346/38; 73/49.5, 167; 116/114 P, 114 Q

[56] References Cited

U.S. PATENT DOCUMENTS

| | | | |
|---|---|---|---|
| 91,864 | 6/1869 | Palliser | 89/16 |
| 727,767 | 5/1903 | Emery | 89/16 |
| 1,772,507 | 8/1930 | Barnes | 89/16 |
| 1,975,832 | 10/1934 | De Florez | 116/114 Q |
| 3,742,640 | 7/1973 | Thomsen | 89/16 |

FOREIGN PATENT DOCUMENTS

| | | | |
|---|---|---|---|
| 825,783 | 12/1959 | United Kingdom | 73/49.5 |

*Primary Examiner*—Stephen C. Bentley

*Attorney, Agent, or Firm*—Pollock, Vande Sande & Priddy

[57] ABSTRACT

Existence of cracks through the liner of a gun barrel is determined by sizing the outer tube of the barrel to expand and jam in the recoil jacket in response to pressure between the liner and the tube; or by providing electrical conductors between the tube and the liner which change their electrical characteristics when cracks form; or by permitting powder gases to leak through small openings in the tube as an indication of failure; or by a combination of these methods.

4 Claims, 3 Drawing Figures

GUN BARREL

BACKGROUND OF THE INVENTION

The invention is then particularly suitable for use for high pressure barrels, that is barrels dimensioned to withstand pressures of magnitudes of 300 – 700 MPa. In order that the barrel shall be able to withstand such pressures, while maintaining a low weight, it is necessary that it be made of a material with a high yield point.

When firing with gun barrels, cracks arise from the crackling of the surface that may be obtained as early as from the first rounds, which cracks extend further for each round fired. Detailed studies of these strength problems have shown that such cracks, notwithstanding precision manufacture, in the most adverse cases can be formed comparatively rapidly, so that the risk for a rupture of the barrel will be appreciable a long time before the barrel would be considered to be worn out according to the standards now in use. Present standards are based upon the number of rounds fired, ageing, and similar factors.

SUMMARY AND OBJECTS OF THE INVENTION

According to the present invention it is possible, in a simple way, to base the rejection criterion for a barrel on a maximum value of the depth of inferred fatigue cracks in the bore of the barrel. This makes it possible, while maintaining maximum safety against barrel rupture, to utilize each individual barrel to the maximum, as it no longer need be rejected after statistically calculated safe life values. With the present invention, it is also possible instead of utilizing the average increase in the life of the barrels comprised in the manufacturing series, to use the advantages gained for better barrel performance such as the muzzle velocity of the rounds, without increasing the risks for the gun crew.

In accordance with the concept of the invention, the barrel liner interacts with an indication device so that indication takes place when there is a fatigue crack that goes through the material in the liner. The liner can then be chosen with a thickness of material so that a crack may go through the material all the way to the boundary surface between the liner and the tube, before the rejection limit is reached; while the tube is dimensioned to withstand the gas pressure at the boundary surface while firing at least a limited number of rounds, without being ruptured.

Because of this construction of the barrel, an indication can quite simply be obtained when a crack reaches the boundary surface between the liner and the tube. This indication can be provided in one embodiment by dimensioning the tube so that in the recoiled position of the barrel it will be jammed in the recoil jacket for the barrel; in a further embodiment by sensing powder gas leaking out in indication holes connected to the boundary surface between the liner and the jacket; and in yet another embodiment by an electrical conductor running in a groove in the boundary surface between the liner and the barrel which changes its resistance at the displacements of material in the tube and/or the liner so that an indication can be obtained in an electric circuit. When an indication is obtained that there are fatigue cracks running through the liner, the barrel can be rejected, or a new liner inserted.

BRIEF DESCRIPTION OF THE DRAWING

An example of an embodiment having the characteristics significant for the invention will be described in the following, with reference to the attached drawings, in which.

DETAILED DESCRIPTION OF THE PREFERRED EMBODIMENTS

Figure 1:
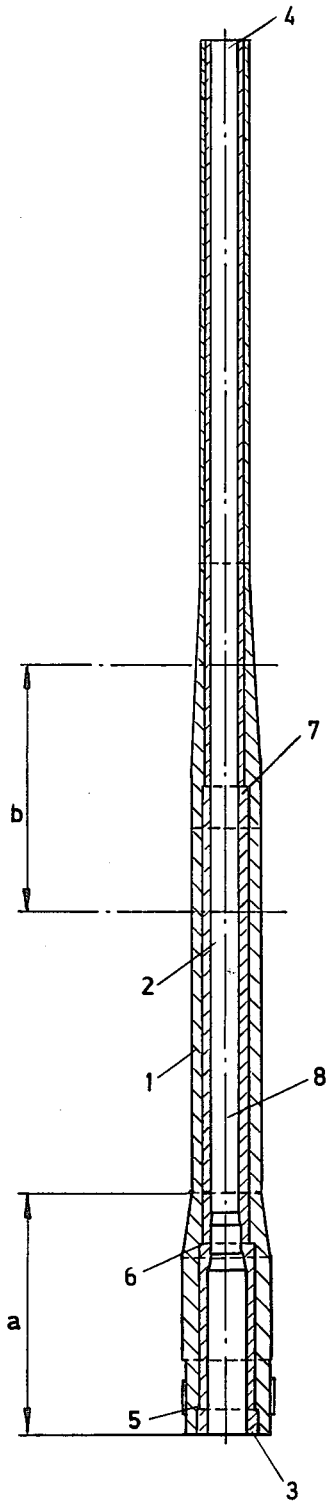
FIG. 1 shows a horizontal section of a barrel.

FIG. 1 shows a barrel with external dimensions which substantially correspond to the external dimensions of a comparable conventional barrel of the corresponding calibre. The barrel comprises an outer part in the form of a tube 1 and an inner part in the form of a liner 2, which in the example of the embodiment covers the inner surface of the tube along the entire longitudinal extent of the barrel. In principle, it is sufficient if the liner is arranged at the weakest parts of the tube, from the point of view of strength. The barrel consists of a high pressure barrel which is capable of withstanding pressures of the magnitude of 300 – 700 MPa. Both the liner and the tube are made of material with a high yield point.

In the present case, the liner and tube are fastened together by means of so-called autofrettage, according to which the liner is first inserted in its place inside the barrel, the ends of the barrel are plugged, and the liner is pressed with a very high internal pressure against the inner surface of the tube. In order to facilitate the insertion of the liner, before the autofrettage, the liner has external dimensions which give a small play in relation to the internal dimensions of the tube.

Although the autofrettage assembly method provides special advantages in the present case, fastening of the tube and the liner can also be accomplished by means of jacketing through heating of the barrel so that the diameters can be cylindrical, with steps or shoulders 5, 6, 7 as shown in the FIGS. or without steps or shoulders. A third alternative for fastening is a so-called pressed in tapered liner.

Figure 2:
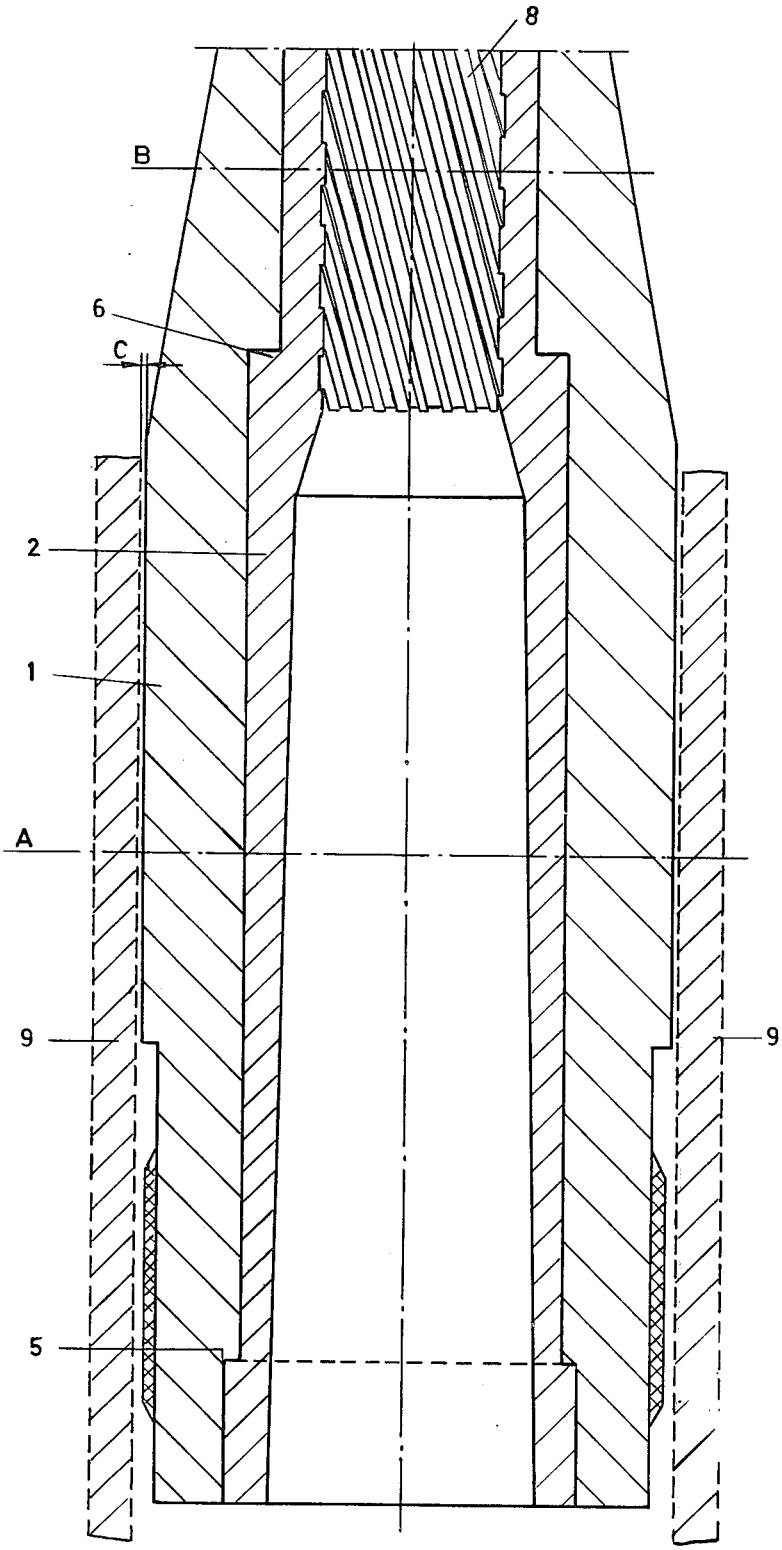
FIG. 2 shows an enlarged horizontal section taken along length "*a*" of FIG. 1, complemented with further first parts.

In FIG. 2, rifling grooves 8 are arranged in the liner, and a recoil jacket 9 for the gun is shown in part, in which the barrel is mounted. To obtain a direct indication that there are fatigue cracks running through liner 2 in the barrel tube 1 is dimensioned so that it will be enlarged when subjected to an internal gas pressure of normal size. The narrow space *c* between the outer surface of the tube 2 and the recoil jacket 9 will then disappear, so that tube 2 will be jammed in the recoil jacket, which prevents run-out for the next round.

Figure 3:
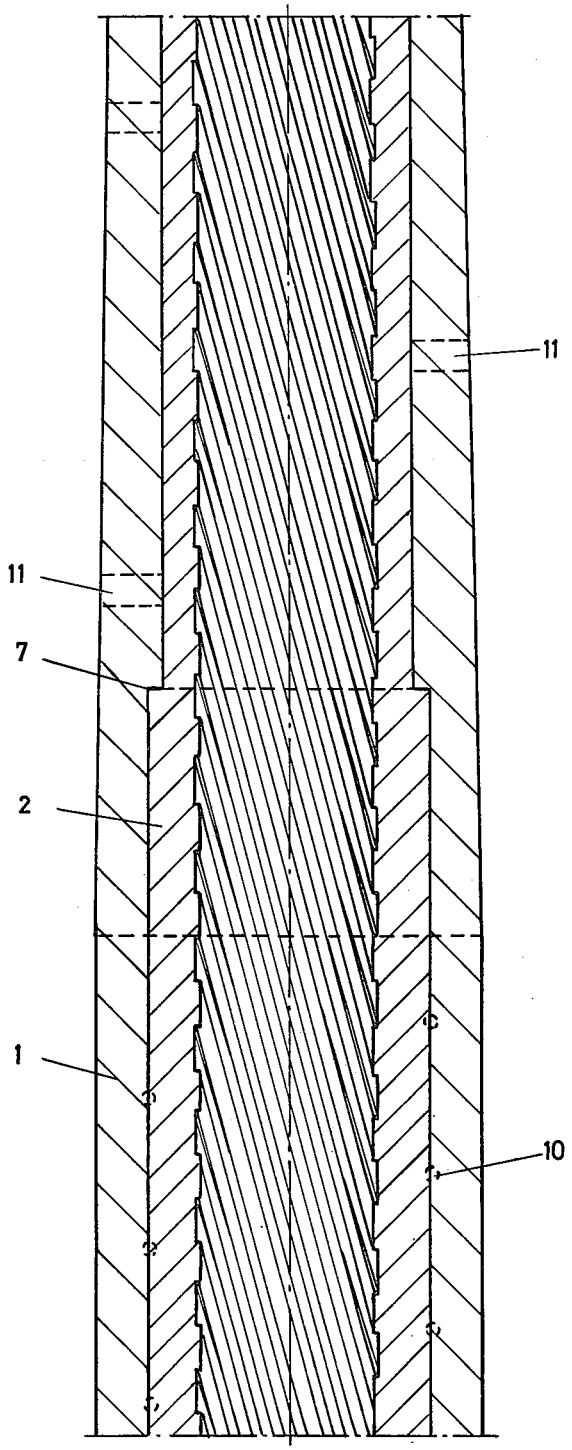
FIG. 3 shows an enlarged horizontal section taken along length "*b*" of FIG. 1, complemented with further second parts.

FIG. 3 shows a further embodiment of an indication device for obtaining a direct indication of fatigue cracks running through the liner. A helical groove is arranged in the junction between tube 1 and liner 2 and an electric conductor is inserted in the groove, the conductor being included in a closed loop of an electric circuit not shown. When displacements of the material take place in the tube and/or the liner, the electrical conductor is stretched out or broken off, which can quite simply be indicated electrically. The helical groove is assumed to extend partly or entirely along the length of the barrel.

However, the groove is only shown partly in FIG. 3, by the holes 10 indicated with dash lines. The groove can also have a different configuration, and it can, for instance, be entirely longitudinal, or can consist of a combination of a circular and longitudinal grooves.

A third possibility of obtaining indication is to provide the tube with holes running through the tube which extend in to the boundary surface between the tube and the liner. Said indication holes are placed along the length of the barrel, and in FIG. 3 such holes 11 are shown. When fatigue cracks run through the liner, gas will leak out through the indication holes, and indicate that the barrel should be rejected.

A further possibility of ensuring that the barrel is in entirely satisfactory condition is to subject it to a pressure test, and check its capability of maintaining the pressure applied. The pressure testing device then forms the indication device. The respective indication methods can be utilized individually or in combination with one or several of the other indication methods.

The invention is not limited to the embodiments shown above as examples, but can be subject to modifications within the scope of the accompanying claims.

We claim:

1. An improved gun barrel comprising:

an outer tube dimensioned to withstand internal gas pressure of the magnitude encountered during firing of a gun embodying said barrel for a small number of rounds without rupture;

an inner liner located within said outer tube and so dimensioned to withstand said gas pressure for a large number of rounds that a crack may extend completely through said inner liner to its boundary with said outer tube before the rejection limit for said barrel is reached; and means cooperating with said outer tube and said inner liner for providing an indication of the presence of a crack extending through said inner liner to said boundary, said indicating means comprising at least one conductor between said outer tube and said inner liner in position to be broken or deformed by movement of said inner liner or said outer tube or both of them under the influence of powder gas pressure coming through a crack in said inner liner, whereby changes in the electrical characteristics of said conductor provide an indication of the presence of a crack through said inner liner.

2. A gun barrel according to claim 1, wherein said conductor is inserted in a groove located at the interface between said outer and said inner liner, said groove extending at least partially along the length of said barrel.

3. A gun barrel according to claim 2, wherein said groove is helical.

4. A gun barrel according to claim 2, wherein said inner liner has been secured within said outer tube by means of autofrettage.

* * * * *